US007337858B2

(12) United States Patent
Hall et al.

(10) Patent No.: US 7,337,858 B2
(45) Date of Patent: Mar. 4, 2008

(54) DRILL BIT ASSEMBLY ADAPTED TO PROVIDE POWER DOWNHOLE

(76) Inventors: David R. Hall, 2185 S. Larsen Pkwy., Provo, UT (US) 84606; Francis Leany, 2185 S. Larsen Pkwy., Provo, UT (US) 84606

( * ) Notice: Subject to any disclaimer, the term of this patent is extended or adjusted under 35 U.S.C. 154(b) by 176 days.

(21) Appl. No.: 11/277,380

(22) Filed: Mar. 24, 2006

(65) Prior Publication Data

US 2007/0114066 A1 May 24, 2007

Related U.S. Application Data

(63) Continuation-in-part of application No. 11/306,976, filed on Jan. 18, 2006, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 47/00* (2006.01)

(52) U.S. Cl. ..... 175/40; 175/57; 175/385; 175/382; 175/426

(58) Field of Classification Search ..... 175/381, 175/382, 385, 425, 426, 321, 40, 57
See application file for complete search history.

(56) References Cited

U.S. PATENT DOCUMENTS 465,103 A 12/1891 Wegner
616,118 A 12/1898 Kuhne
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford
1,821,474 A 9/1931 Mercer
2,054,255 A 9/1936 Howard
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,643,860 A * 6/1953 Koch ..... 175/99

(Continued)

*Primary Examiner*—Hoang Dang
(74) *Attorney, Agent, or Firm*—Tyson J Wilde

(57) ABSTRACT

In one aspect of the invention, a drill bit assembly has a body portion intermediate a shank portion and a working portion, the working portion having at least one cutting element. The working portion also has an opening to an axial chamber disposed in the body portion of the assembly. The drill bit assembly also has an axial shaft rotationally isolated from the body portion, the shaft being at least partially disposed within the chamber, and partially protruding form the working portion. The shaft is also in communication with an energy adapter disposed within the drill but assembly and is adapted to use relative motion between the body portion and the shaft to provide power to at least one downhole device.

21 Claims, 9 Drawing Sheets

U.S. PATENT DOCUMENTS

| | | | | | |
|---|---|---|---|---|---|
| 2,755,071 | A | | 7/1956 | Kammerer | |
| 2,819,041 | A | * | 1/1958 | Beckham | 175/93 |
| 2,901,223 | A | | 8/1959 | Scott | |
| 2,942,850 | A | * | 6/1960 | Heath | 175/96 |
| 2,963,102 | A | | 12/1960 | Smith | |
| 3,379,264 | A | | 4/1968 | Cox | |
| 3,493,165 | A | | 2/1970 | Schonfeld | |
| 3,960,223 | A | | 6/1976 | Kleine | |
| 4,081,042 | A | | 3/1978 | Johnson | |
| 4,106,577 | A | | 8/1978 | Summers | |
| 4,307,786 | A | | 12/1981 | Evans | |
| 4,416,339 | A | | 11/1983 | Baker | |
| 4,448,269 | A | | 5/1984 | Ishikawa | |
| 4,531,592 | A | | 7/1985 | Hayatdavoudi | |
| 4,566,545 | A | | 1/1986 | Story | |
| 4,962,822 | A | | 10/1990 | Pascale | |
| 5,009,273 | A | | 4/1991 | Grabinski | |
| 5,038,873 | A | | 8/1991 | Jurgens | |
| 5,141,063 | A | | 8/1992 | Quesenbury | |
| 5,361,859 | A | | 11/1994 | Tibbitts | |
| 5,417,292 | A | | 5/1995 | Polakoff | |
| 5,507,357 | A | | 4/1996 | Hult | |
| 5,560,440 | A | | 10/1996 | Tibbitts | |
| 5,568,838 | A | | 10/1996 | Struthers | |
| 5,678,644 | A | | 10/1997 | Fielder | |
| 5,896,938 | A | | 4/1999 | Moeny | |
| 6,202,761 | B1 | | 3/2001 | Forney | |
| 6,439,326 | B1 | | 8/2002 | Huang | |
| 6,533,050 | B2 | | 3/2003 | Molloy | |
| 6,601,454 | B1 | | 8/2003 | Botnan | |
| 6,668,949 | B1 | | 12/2003 | Rives | |
| 6,732,817 | B2 | | 5/2004 | Dewey | |
| 6,929,076 | B2 | | 8/2005 | Fanuel | |
| 6,953,096 | B2 | | 10/2005 | Gledhill | |

* cited by examiner

DRILL BIT ASSEMBLY ADAPTED TO PROVIDE POWER DOWNHOLE

CROSS REFERENCE TO RELATED APPLICATIONS

This patent application is a continuation-in-part of U.S. patent application Ser. No. 11/306,976 which was filed on Jan. 18, 2006 and entitled "Drill Bit Assembly for Directional Drilling." U.S. patent application Ser. No. 11/306,976 is a continuation-in-part of 11/306,307; now U.S. Pat. No. 7,255,886; filed on Dec. 22, 2005, entitled Drill Bit Assembly with an Indenting Member. U.S. patent application Ser. No. 11/306,307 is a continuation-in-part of U.S. patent application Ser. No. 11/306,022; now U.S. Pat. No. 7,198,119; filed on Dec. 14, 2005, entitled Hydraulic Drill Bit Assembly. U.S. patent application Ser. No. 11/306,022 is a continuation-in-part of U.S. patent application Ser. No. 11/164,391; now U.S. Pat. No. 7,270,196; filed on Nov. 21, 2005, which is entitled Drill Bit Assembly. All of these applications are herein incorporated by reference in their entirety.

BACKGROUND OF THE INVENTION

The present invention relates to the field of downhole drilling for oil, gas, and geothermal exploration. With a continually increasing demand for downhole drilling, the ability to drill more effectively through the use of electronics in a drill string has become more popular. Such electronics may be used to determine the direction of drilling, monitor the condition of the drilling equipment, determine subsurface formation parameters, and so forth. In order for the electronics to work they must have power. The present invention provides a method, apparatus and system for generating power downhole.

U.S. Pat. No. 6,191,561 which is herein incorporated by reference for all that it contains, discloses an apparatus for generating and regulating power downhole by varying the alignment of a pair of axially adjacent permanent magnets attached to a drive shaft which rotates within an armature having electrically conductive windings. In the current invention the shaft of the generator is preferably connected to a mud turbine engine.

U.S. Pat. No. 5,965,964 which is herein incorporated by reference for all that it contains, discloses a generator having a sleeve slidably disposed within a housing which oscillates in response to the application of fluid pressure to the current generator. A piston is slidably attached to the sleeve and oscillates relative to the sleeve and the housing. The piston extends longitudinally into a generator section and has a plurality of magnets attached thereto which oscillate with the piston. Wire coil sections are fixed relative to the housing of the generator section and are positioned between the oscillating magnets such that a current is induced in the wire coil sections upon oscillation of the magnets.

U.S. Pat. No. 6,691,802 which is herein incorporated by reference for all that it contains, discloses a drill string equipped with a downhole assembly having an instrumented sub and a drill bit. The instrumented sub has a power source that requires no electrical chemical batter. A mass-spring system is used, which during drilling causes a magnet to oscillate past a coil. This induces current which is used to power downhole instruments.

U.S. Pat. No. 6,504,258 which is herein incorporated by reference for all that is contains, discloses a downhole power generator that produces electrical power for use by downhole tools. In a described embodiment, a downhole power generator includes a member that is vibrated in response to fluid flow through a housing. Vibration of the member causes a power generating assembly to generate electrical power.

BRIEF SUMMARY OF THE INVENTION

In one aspect of the invention, a drill bit assembly has a body portion intermediate a shank portion and a working portion, the working portion having at least one cutting element. The working portion also has an opening to an axial chamber disposed in the body portion of the assembly. The drill bit assembly also has an axial shaft rotationally isolated from the body portion, the shaft being at least partially disposed within the chamber, and partially protruding form the working portion. The shaft is also in communication with an energy adapter disposed within the drill but assembly and is adapted to use relative motion between the body portion and the shaft to provide power to at least one downhole device.

An energy adapter is a device which extracts energy from the relative rotation and modifies its form. In some cases the energy adapter will convert the energy into another energy form. For example, an energy adapter may convert a magnetic field into electric magnetic energy. In other embodiments, the energy adapter may simply modify the mechanical energy provided by the shaft by changing its magnitude and/or direction. For example the amount of torque provided by the shaft and the direction that the torque is applied may be changed when the energy adapter comprises a gear assembly. In other embodiments, the mechanical energy provided by the relative rotation may be transmitted into a hydraulic circuit when the energy adapter comprises a pump. The energy provided by the energy adapter to the downhole device may be mechanical energy, hydraulic energy, electric energy, magnetic energy, or combinations thereof.

The energy adapter may comprise a coil, a wire, a magnetically conducting material, a pump, an electrically conducting material, a gear assembly or combinations thereof. The shaft may comprise a magnetic material which is disposed proximate the energy adapter. In such an embodiment, the energy adapter may be a coil that is adapted to convert a magnetic field provided by the magnetic material into electric energy.

The shaft may be partially disposed within an axial chamber formed in the body portion of the assembly. A proximal end of the shaft may be located within the chamber or it may be disposed within a downhole tool string component attached to the drill bit assembly. An insert may be disposed within the chamber and/or downhole tool string component and surround at least a portion of the shaft. The insert may be used to provide stability or act as a bearing. In some embodiments, the insert may be adapted to rotate relative the body portion and with the shaft.

The power provided may be used to power a sensor, a battery, a motor, electronic equipment, a piston, an actuator, memory, Peltier device, or combinations thereof. In some embodiments, the shaft may be substantially coaxial with the shank portion, the body portion, working portion, or combinations thereof.

In another aspect of the invention, a method comprises the steps of providing a drill bit assembly with a body portion intermediate a shank portion and a working portion; providing a shaft rotationally isolated from the body portion; providing an energy adapter in the body portion of the assembly; contacting the shaft with a subsurface formation such that the shaft rotates relative to the assembly; and using relative rotation between the shaft and the energy adapter to provide energy to at least one downhole device.

In yet another aspect of the present invention, a system has a string of downhole components intermediate a drill bit assembly and a surface of the earth. The drill bit assembly has a body portion intermediate a shank portion and a working portion, the working portion having at least one cutting element. The working portion also has an opening to an axial chamber which is disposed within the body portion of the drill bit assembly. The drill bit assembly further has a shaft rotationally isolated from the body portion, the shaft being at least partially disposed within the chamber and partially protruding from the working portion. The shaft is in communication with an energy adapter disposed within the drill bit assembly; wherein the energy adapter is adapted to use relative motion between the body portion and the shaft to provide energy to at least one downhole device.

DETAILED DESCRIPTION OF THE INVENTION AND THE PREFERRED EMBODIMENT

Figure 1:
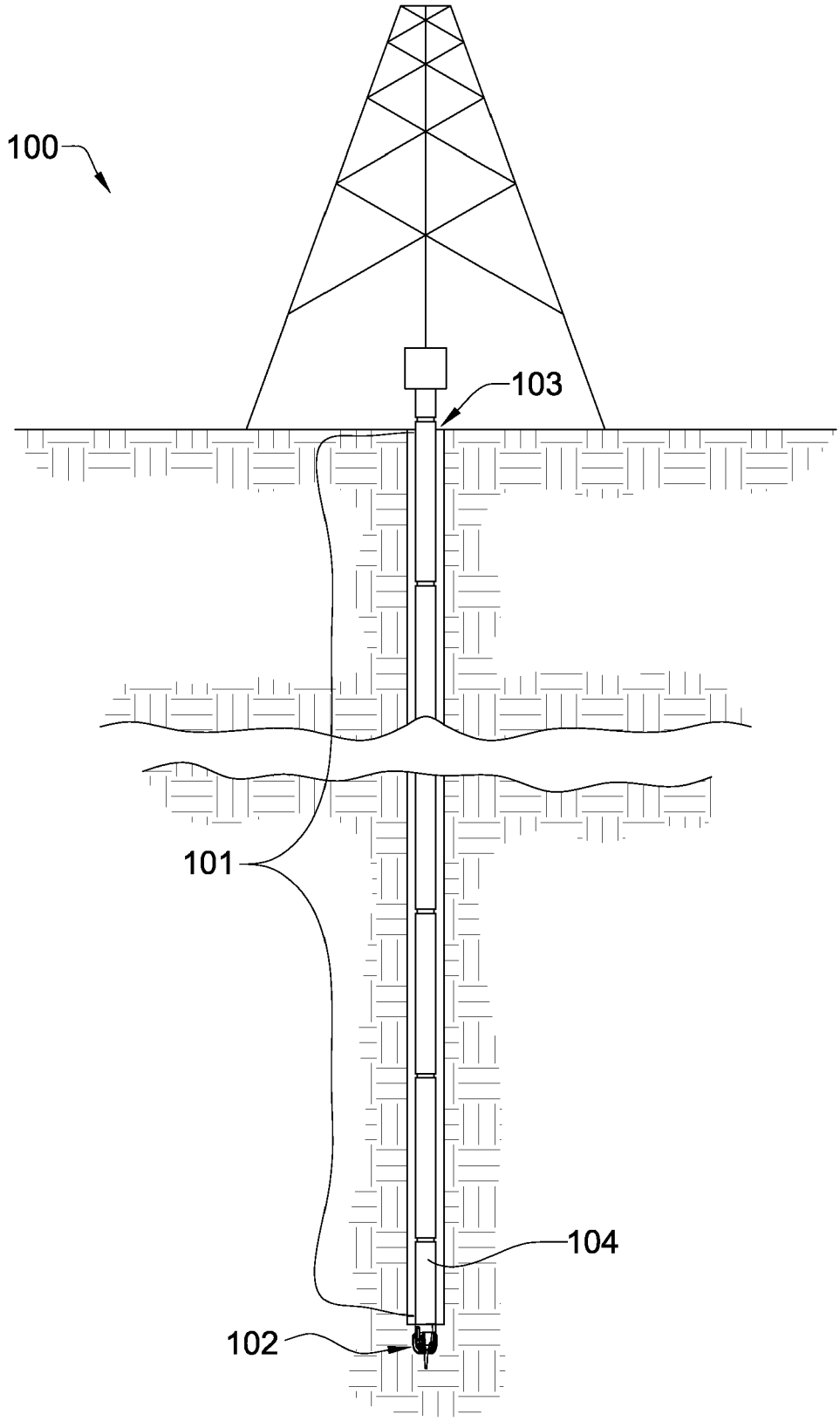
FIG. 1 is a perspective diagram of an embodiment of a drill site.

Referring now to the drawings, FIG. 1 is a diagram of a drill site, which includes a system 100 for providing power downhole. The system 100 comprises a drill string 101 intermediate a drill bit assembly 102 and a surface of the earth 103. Drill collars and/or heavy weight pipe 104 may be attached at the bottom of the drill string 101 to provide weight on the drill bit assembly 102.

Figure 2:
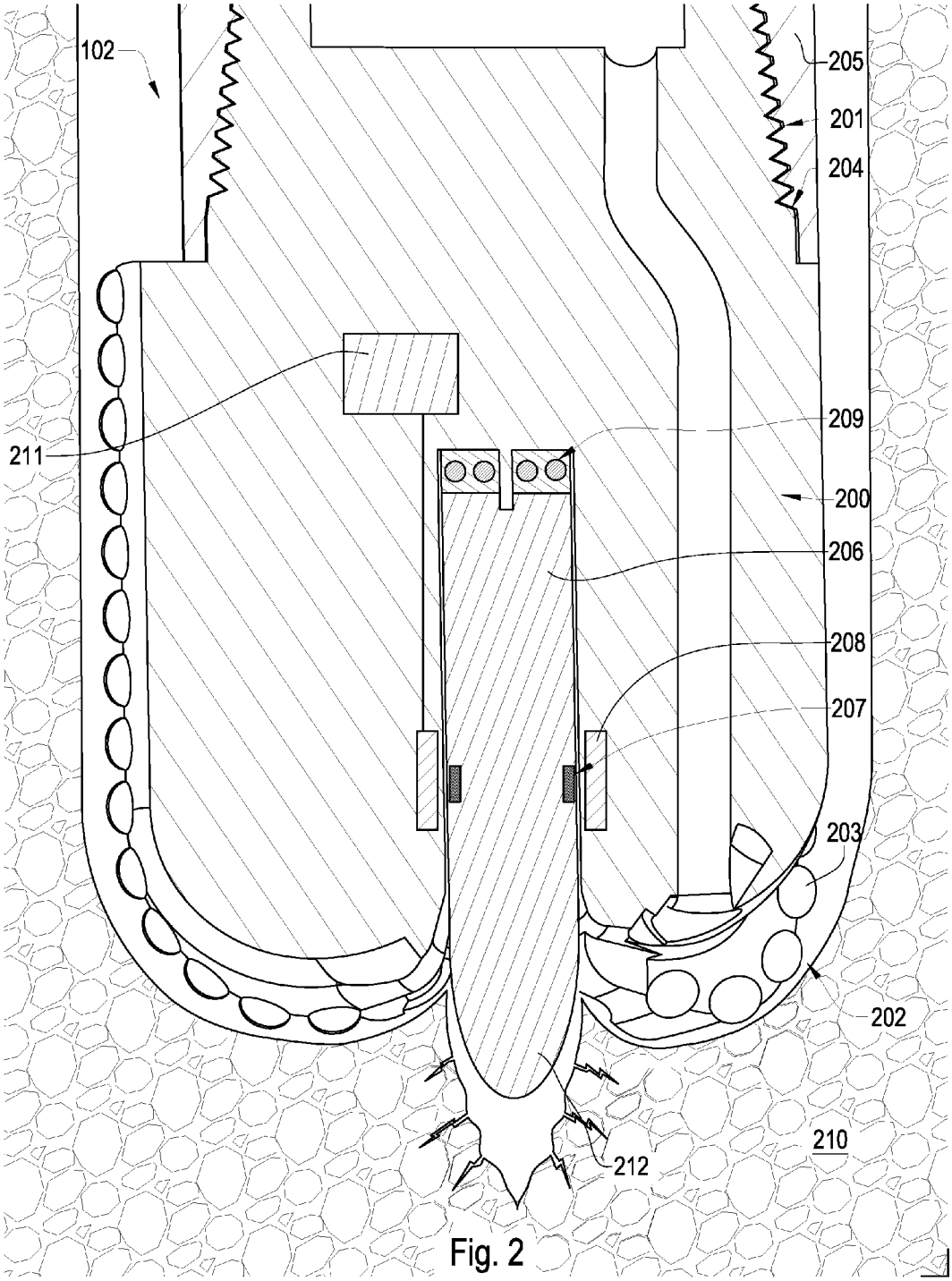
FIG. 2 is a cross-sectional diagram of an embodiment of a drill bit assembly.

Referring now to FIG. 2, the drill bit assembly 102 may comprise a body portion 200 intermediate a shank portion 201 and a working portion 202. The working portion 202 may have at least one cutting element 203. The shank portion 201 may be attached to the drill string 205 with a threaded connection 204. The drill bit assembly 102 may have a shaft 206 rotationally isolated from the body portion 200 comprising magnetic material 207 in communication with an energy adapter 208 disposed within and rotationally fixed to the body portion 200. There may be a plurality of bearings 209 placed between the rotationally isolated shaft 206 and the body portion 200 for providing the rotational isolation. The bearings 209 may be composed of a material of ceramics, silicon nitride, metals, diamond, metal alloys, polymers and combinations thereof. The bearings 209 may be roller bearings, ball bearings, plain bearings, taper bearings, thrust bearings, or combinations thereof. In some embodiments, the bearings 209 are sealed from the drilling mud and outside environment to prevent corrosion and wear. In some embodiments it may be desirable to use the drilling mud to lubricate the bearing, such as when the bearings are made of diamond.

As the drill bit assembly 102 rotates within the formation 210 the rotationally isolated shaft 206 may contact the formation 210 causing relative rotation between the body portion 200 and the rotationally isolated shaft 206. In some embodiments, the shaft 206 may be rotationally fixed with respect to the formation 210. The rotation may cause the magnetic material 207 and the energy adapter 208 to move with respect to each other and generate electrical power. That electrical power may be used to power sensors 211, run electronics, or charge a battery. The rotationally isolated shaft 206 may comprise a geometry; such as protrusions or indentations; on its surface 212 to help increase friction between the shaft 206 and the subsurface formation 210. An increase in friction may provide more power since it may increase relative movement between the shaft 206 and the body portion 200 of the assembly 102.

The rotationally isolated shaft 206 may very in width, length and the material depending on the characteristics of the subsurface formation 210. It may also be critical to use a rotationally isolated shaft 206 that extends beyond the drill bit assembly 102 by only a small distance which may be beneficial in harder formations. Preferably, the shaft is substantially coaxial with the body portion 200 or shank portion 201 of the assembly 102. In some embodiments, the shaft may protrude out of a recess formed in the working portion 202. The recess may be part of a geometry of the working portion 202 that allows a protrusion in the subsurface formation 210 to be formed during drilling. The shaft 206 may penetrate and wedge itself in this formation 210 due to the weight of the tool string loaded onto the shaft. As drilling progresses the shaft 206 may compressively fail the protrusion.

The magnetic material 207 and the energy adapter 208 may be arranged in a variety of configurations. In some embodiments, the magnetic material may be fixed to the surface of the shaft 206 (preferably in recesses) so that the magnetic field is less affected by the material of the shaft 206 or the magnetic material may be embedded within the shaft 206.

In other embodiments, a magnetically conducting material 250 (shown in FIG. 7) may be used to help direct the magnetic field towards the energy adapter 208. The magnetically conducting material may be a metal, ceramics, iron, nickel, ferrite, or combinations thereof may. In some embodiments, the magnetic material 207 may be placed in a U-shaped trough of ferrite or other magnetically conductive material. It is believed that in such an embodiment the magnetically conductive material may direct at least a portion of the magnetic field towards the energy adapter that would have otherwise dispersed into other portions of the drill bit assembly 102. In some embodiments a magnetically resistive material may also manipulate the magnetic field and help direct it towards the energy adapter 208. Manipulating the magnetic field may also allow the use of certain equipment or sensors 211 that may be sensitive to magnetism, by directing the magnetic field away from that equipment.

Figure 3:
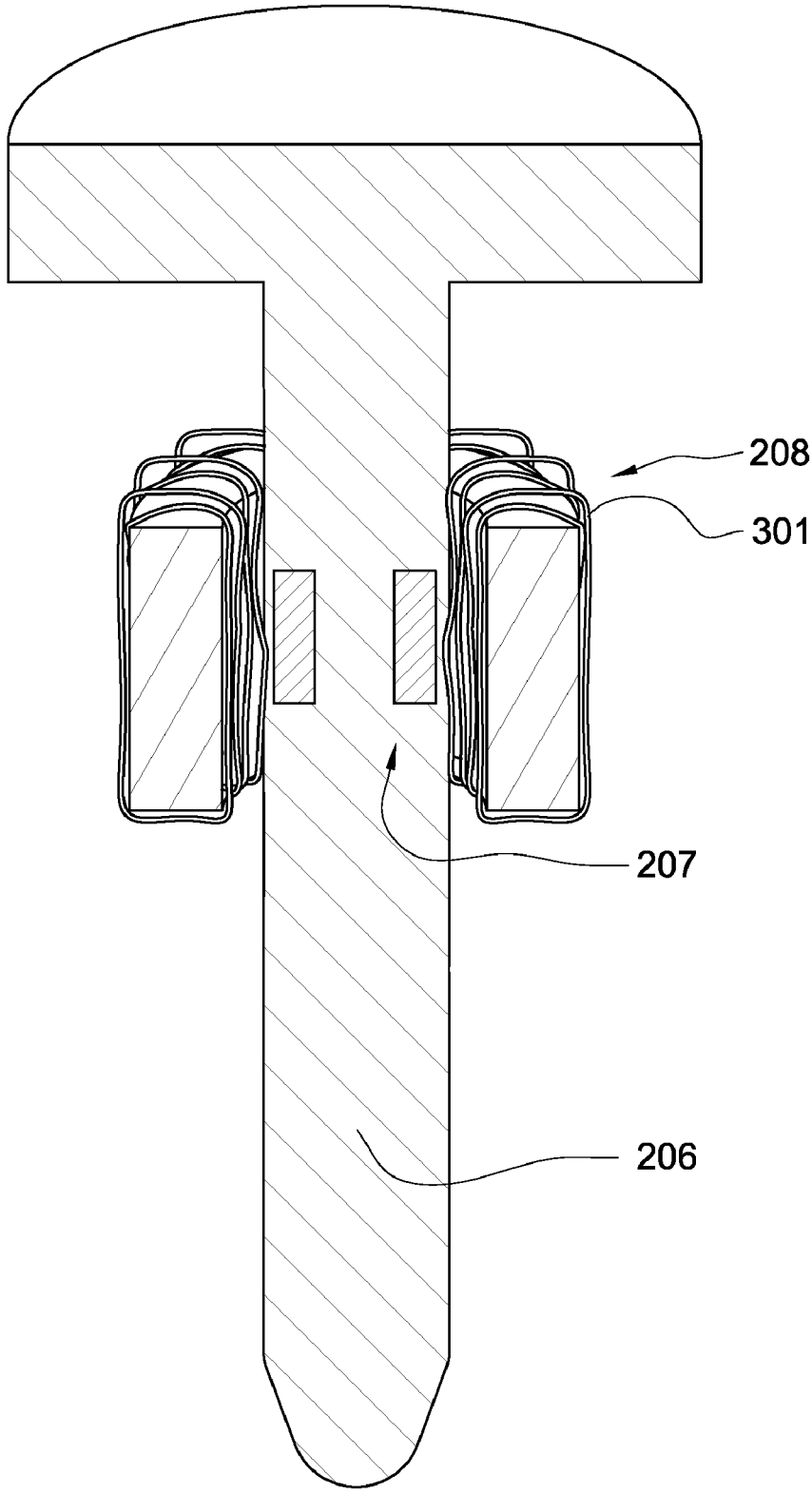
FIG. 3 is a cross-sectional diagram of an embodiment of a rotationally isolated shaft.

FIG. 3 is a diagram of another embodiment of a rotationally isolated shaft 206 and the magnetic material 207 and the energy adapter 208. The magnetic material may be a ferromagnetic metal or metal alloy such as Fe, Co, Ni, $FeOFe_2O_3$, $NiOFe_2O_3$, $CuOFe_2O_3$, $MgOFe_2O_3$, MnBi, MnSb, $MnOFe_2O_3$, $Y_3Fe_5O_{12}$, $CrO_2$, MnAs and combinations thereof. Preferably the magnetic material has a curie temperature above 100° C. to prevent loss of the magnetization of the material while in a high temperature downhole environment. In some embodiments, it may be necessary for the magnetic material to have a curie temperature over 200° C. or even 300° C. The energy adapter 208 may comprise a coil 301 or a wire. The coil 301 may be wound so that a magnetic field created by the magnetic material 207 induces an electric current in the coil 301 when the rotationally isolated shaft 206 is moves relative to the energy adapter. The coil 301 may be enclosed in a sealed chamber (not shown). The coil 301 may further be coated with an electrically layer (not shown) such as Polyetheretherketones (PEEK®), polymers, epoxy, or Teflon®. In other embodiments, a wire of the energy adapter may be surrounded by a magnetically conductive material such as nickel, iron, or ferrite. Ferrite may be preferable since it is also electrically insulating. In some embodiments, of the energy adapter the coil may be wrapped around a magnetically conductive core, such as ferrite, iron, nickel, alloys, mixtures, or combinations thereof.

Figure 4:
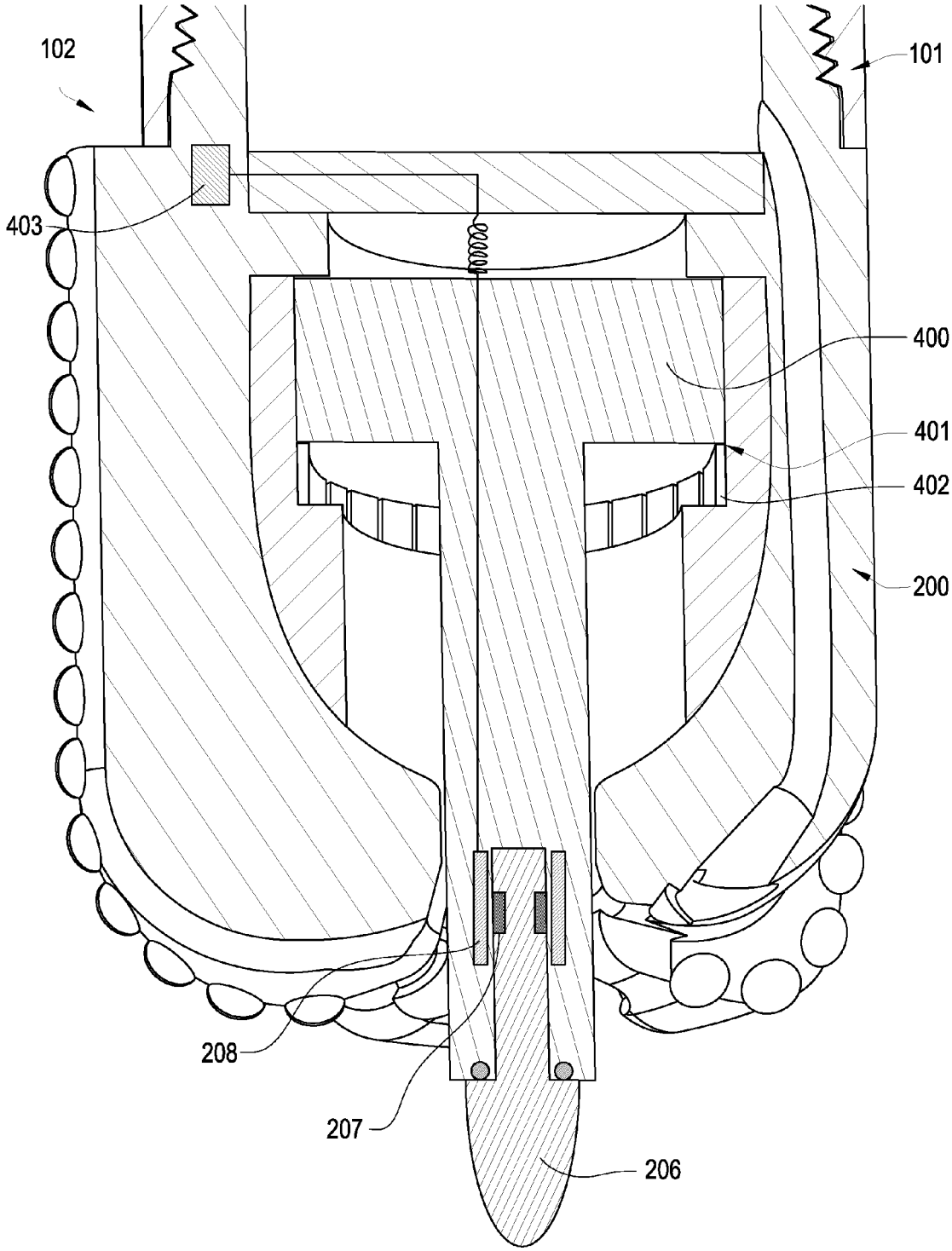
FIG. 4 is a cross-sectional diagram of an embodiment of a drill bit assembly with and insert.

Referring now to FIG. 4, the drill bit assembly 102 may comprise an insert 400 comprising radial projections 401 which may fit into corresponding slots 402 on the body portion 200 of the drill bit assembly 102. The slots may rotationally fix the insert 400 to the body portion 200 of the drill bit assembly 102 while allowing longitudinal movement. The rotationally isolated shaft 206 may be placed in the insert 402 which may extend beyond the drill bit assembly 102. The energy adapter 208 may be disposed within the insert 402. In such an embodiment the rotationally isolated shaft 206 may rotationally fix to a subsurface formation and rotate within the insert 402. The electrical power generated may be carried away through an electrically conducting medium disposed within or adjacent the insert. The electrical power may be used to recharge a downhole battery 403.

In the embodiment of FIG. 4, the rotationally isolated shaft 206 may be substantially coaxial with the drill sting 101, body portion, working portion, or shank portion. A substantially coaxial, rotationally isolated shaft 206 may rotate within the body portion 200 while at the same time stabilize the drill bit assembly. It is believed, that the stabilization provided by the rotationally isolated shaft may improve drilling conditions such that more weight may be loaded to the drill bit assembly than with non-stabilized drill bit assemblies. The ability of the shaft to move vertically within the body portion may help the rotationally isolated shaft absorb shock produced from bit bounce. It is believed that the added stabilization may allow some sensitive electronic equipment that would not survive the vibrations of traditional drill bits to exist in the drill bit assembly.

Figure 5:
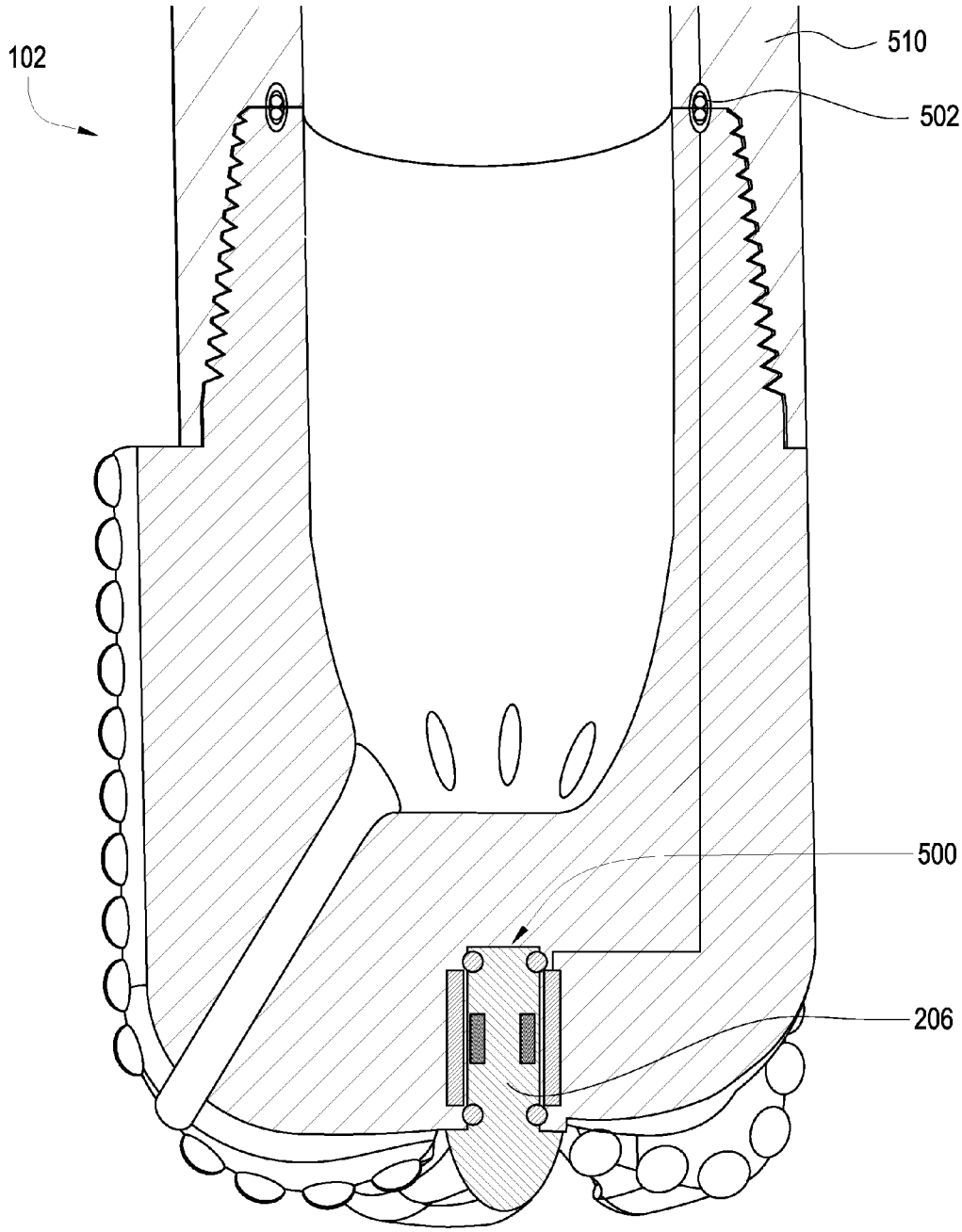
FIG. 5 is a cross-sectional diagram of another embodiment of a drill bit assembly.

FIG. 5 is a diagram of a drill bit assembly 102 with the rotationally isolated shaft 206 being disposed partially in an axial chamber 500. In the present embodiment the rotationally isolated shaft 206 is a shaft which slightly protrudes from the end of the drill bit assembly 102. Other embodiments may include the rotationally isolated shaft 206 comprising a tubular distal end, triangular distal end, or pyramidal distal end. Also shown is an electrically conducting medium (which may be electrically insulated from the body portion), which is in electrical communication with a coupler 502. The electrical power may be carried to electronics across a threaded connection between the drill bit assembly and a downhole component 510 via a direct electrical, optical, or inductive coupler 502. In such an embodiment, power may be transmitted across the coupler 502 and power electronics, actuators, batteries, cooling systems or other downhole device in the downhole tool string. An embodiment of an inductive coupler 502 that may be compatible with the present invention is disclosed in U.S. Pat. No. 6,670,880, which is herein incorporated by reference for all that it contains. In some embodiments, a direct electrical connection may be used to transmit power from the drill bit assembly to a downhole component. A coupler 502 comprising a direct electrical connection, as disclosed in U.S. Pat. No. 6,830,467, which is herein incorporated by reference for that it contains, may be compatible with the present invention.

Figure 6:
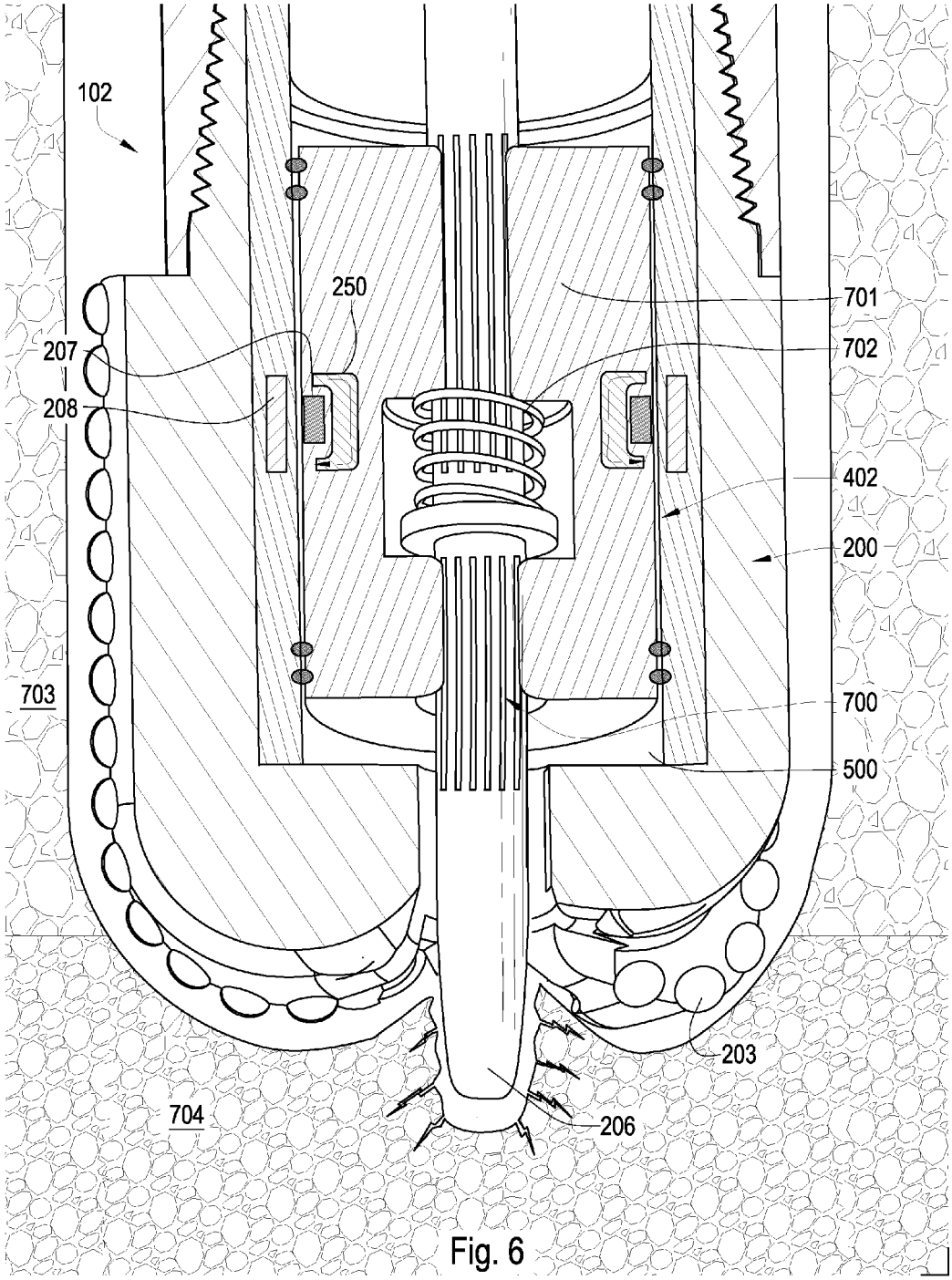
FIG. 6 is a cross-sectional diagram of another embodiment of a drill bit assembly.

FIG. 6 is an embodiment of a drill bit assembly 102 with the rotationally isolated shaft 206 partially disposed within the body portion 200. The rotationally isolated shaft 206 may have splines 700 fixing it to an insert 402 within the chamber 500. In the present embodiment the insert 402 may be a sleeve 701 that is rotationally isolated from the body portion 200 of the drill bit assembly 102. The sleeve 701 may comprise the magnetic material 207 while the body portion 200 comprises the energy adapter 208. A spring 702, or another means of loading the shaft, may be placed between the sleeve 701 and the rotationally isolated shaft 206 to allow longitudinal movement of the rotationally isolated shaft 206 with respect to the sleeve 701. This may be useful when drilling in a formation with multiple densities. If drilling from a soft formation 703 into a hard formation 704, the spring 702 may be able to reduce the impact on the drill bit assembly by absorbing the impact upon shaft contacting the hard formation 704. This may prevent damage to the rotationally isolated shaft 206 as well as the cutting elements 203. Other means for allowing longitudinal movement of the rotationally isolated shaft 206 may also be used, such as a piston, a gas cylinder, or a Belleville washer.

The energy provided by the energy adapter may be used to drive a closed looped cooling circuit or it could be used to power a Peltier device. These mechanisms for cooling may be used to cool the drilling fluid before it exits the nozzles in the drill bit assembly. In such embodiments, electronics and the cutting elements 203 may resist damage caused from exposure to high downhole temperatures. In some embodiments of the present invention, an energy adapter comprising a pump or a gear assembly.

Figure 7:
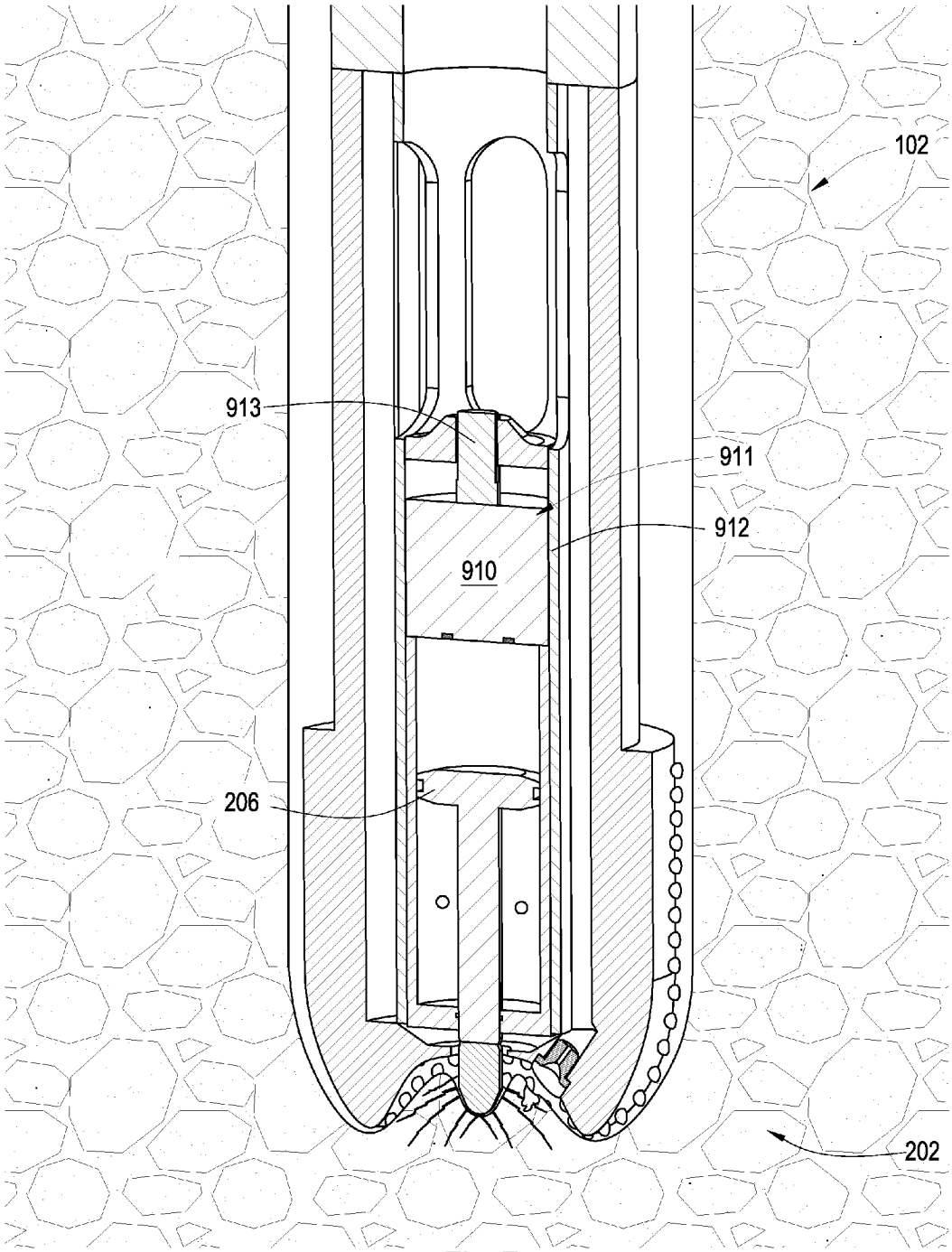
FIG. 7 is a cross-sectional diagram of an embodiment of the drill bit assembly for providing hydraulic power.

FIG. 7 is an embodiment of a drill bit assembly 102 for providing hydraulic power. The rotationally isolated shaft 206 is fixed to a first section 910 of a pump 911 through a tubular sleeve 912 disposed within the body portion 200. A second portion 913 of the pump 911 is fixed to the body portion 200 and a hydraulic circuit (not shown) which is ported though channels in the drill bit assembly 102. The hydraulic circuit may be used to hydraulically raise and lower the rotationally isolated shaft 206 with respect to the working portion 202. In other embodiments, the hydraulic circuit may be in communication with a piston, an actuator, a turbine or combinations thereof. This disclosure incorporates by reference co-pending U.S. patent application Ser. No. 11/306,022 filed on Dec. 14, 2005, entitled Hydraulic Drill Bit Assembly which discloses various possible hydraulic circuits which may be compatible with the present invention.

Figure 8:
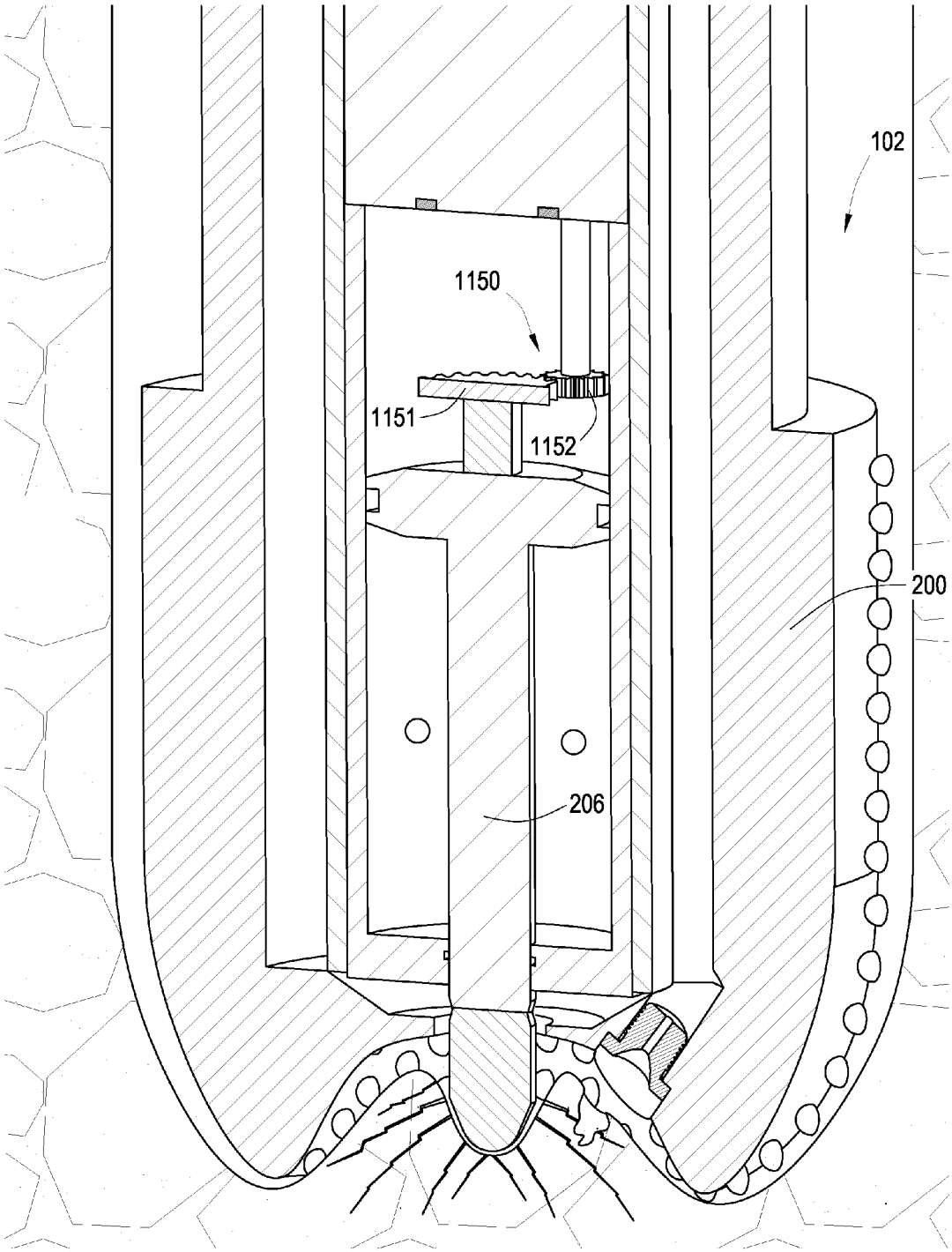
FIG. 8 is a cross-sectional diagram of an embodiment of a drill bit assembly for providing mechanical power.

FIG. 8 is a cross-sectional diagram of a drill bit assembly 102 where the energy adapter is a gear assembly 1150, which may extract and transmit the energy from the relative rotation into various forms of mechanical energy. A primary gear 1151 of the assembly may be attached to the shaft 206. The primary gear 1151 may be adapted to rotate with the shaft 206 as it rotates independent of the body portion 200. At least one secondary gear 1152 attached to the body portion 200 is adapted to be rotated by the primary gear 1151 and may also be adapted to provide mechanical power to a motor, a hydraulic circuit, a turbine, or another downhole device. The gear assembly 1150 may comprise a pinion, a tapered gear, a spur gear, a helical gear, a worm gear, a differential gear, a sector gear, a crown gear, a hub gear, a non-circular gear, or combinations thereof. The gear assembly 1150 may be advantageous since it can increase or decrease the torque provided by the shaft 206 depending on the size of the secondary gear 1152. In some embodiments, the torque provided by the shaft 206 may be converted to a non-parallel axis.

Figure 9:
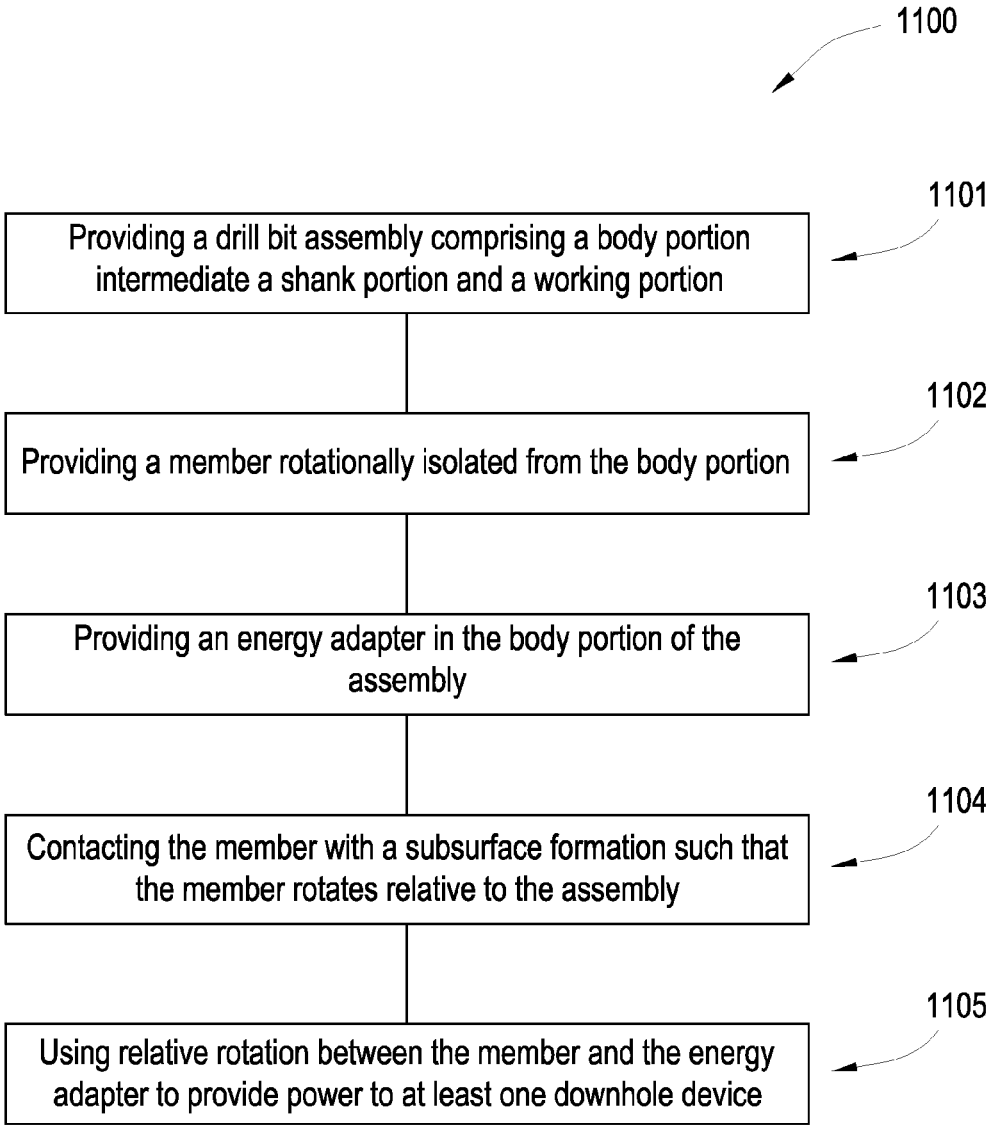
FIG. 9 is a block diagram of an embodiment of a method for providing power downhole.

Now referring to FIG. 9, a method 1100 may include the steps of providing 1101 a drill bit assembly comprising a body portion intermediate a shank portion and a working portion; providing 1102 a shaft rotationally isolated from the body portion; 1103 providing an energy adapter in the body portion of the assembly; contacting 1104 the shaft with a subsurface formation such that the shaft rotates relative to the assembly; and using 1105 relative motion between the shaft and the energy adapter to provide energy to at least one downhole device.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body portion intermediate a shank portion and a working portion;

the working portion comprising an opening to an axial chamber disposed within the assembly;

the working portion comprising at least one cutting element;

the drill bit assembly further comprising an axial shaft rotationally isolated from the body portion, the shaft being at least partially disposed within the chamber, and partially protruding from the working portion; and;

the shaft being in communication with an energy adapter disposed within the drill bit assembly; wherein the energy adapter is adapted to use relative motion between the body portion and the shaft to provide energy to at least one downhole device.

2. The drill bit assembly of claim 1, wherein the energy adapter converts mechanical energy provided by the relative rotation to electric energy.

3. The drill bit assembly of claim 1, wherein the energy adapter comprises a coil, a wire, a magnetically conducting material, a pump, an electrically conducting material, a gear assembly, or combinations thereof.

4. The drill bit assembly of claim 1, wherein the downhole device comprises a sensor, a battery, a motor, electronic equipment, a piston, an actuator, memory, Peltier device, or combinations thereof.

5. The drill bit assembly of claim 1, wherein an insert is disposed within the chamber surrounding at least a portion of the shaft.

6. The drill bit assembly of claim 5, wherein the insert is adapted to rotate relative to the body portion.

7. The drill bit assembly of claim 1, wherein the shaft comprises a magnetic material proximate the energy adapter.

8. The drill bit assembly of claim 1, wherein the shaft is substantially coaxial with the shank portion, the body portion, or combinations thereof.

9. The drill bit assembly of claim 1, wherein the downhole device is in communication with the energy adapter over a network, a hydraulic circuit, or an electrically conducting medium.

10. A method comprising the steps of:

providing a drill bit assembly comprising a body portion intermediate a shank portion and a working portion;

providing a shaft rotationally isolated from the body portion;

providing an energy adapter in the assembly;

contacting the shaft with a subsurface formation such that the shaft rotates relative to the assembly;

using relative rotation between the shaft and the energy adapter to provide energy to a downhole device.

11. The method of claim 10, wherein the energy adapter comprises a coil, a wire, a magnetically conducting material, a gear assembly, a pump, an electrically conducting material, or combinations thereof.

12. The method of claim 10, wherein a magnetic material is disposed within the shaft.

13. The method of claim 12, wherein a magnetic field produced by the magnetic material is manipulated by a magnetically conductive material or a magnetically resistive material.

14. The method of claim 12, wherein the downhole device comprises a sensor, a battery, a motor, electronic equipment, a piston, an actuator, memory, Peltier device, or combinations thereof.

15. The method of claim 12, wherein the downhole device is in communication with the energy adapter over a network, a hydraulic circuit, or an electrically conducting medium.

16. A system comprising:

a string of downhole components intermediate a drill bit assembly and a surface of the earth;

the drill bit assembly comprising a body portion intermediate a shank portion and a working portion;

the working portion comprising an opening to an axial chamber disposed in the drill bit assembly;

the working portion comprising at least one cutting element;

the drill bit assembly further comprising an axial shaft rotationally isolated from the body portion; the shaft being at least partially disposed within the chamber, and partially protruding from the working portion; and;

the shaft being in communication with an energy adapter disposed within the system; wherein the energy adapter is adapted to use relative rotation between the body portion and the shaft to provide energy to at least one downhole device.

17. The system of claim 16, wherein the energy adapter comprises a coil, a wire, a magnetically conducting material, a pump, an electrically conducting material, a gear assembly, or combinations thereof.

18. The system of claim 16, wherein the downhole device comprises a sensor, a battery, a motor, electronic equipment, a piston, an actuator, memory, Peltier device, or combinations thereof.

19. The system of claim 16, wherein the shaft is a roller cone, a shaft, a tube, or a wheel.

20. The system of claim 16, wherein the shaft is substantially coaxial with the shank portion, body portion, or combinations thereof.

21. The system of claim 16, wherein the downhole device is in communication with the energy adapter over a network, a hydraulic circuit, or an electrically conducting medium.

* * * * *